US005832979A

United States Patent [19]

Marusak

[11] Patent Number: 5,832,979

[45] Date of Patent: Nov. 10, 1998

[54] VERTICAL BLIND HAVING HONEYCOMB-SHAPED VANES

[75] Inventor: Thomas J. Marusak, Loudonville, N.Y.

[73] Assignee: Comfortex Corporation Inc., Cohoes, N.Y.

[21] Appl. No.: 245,186

[22] Filed: May 17, 1994

Related U.S. Application Data

[63] Continuation-in-part of Ser. No. 994,673, Dec. 22, 1992, abandoned.

[51] Int. Cl.[6] ..... E06B 9/30

[52] U.S. Cl. ..... 160/173 V; 160/236

[58] Field of Search ..... 160/236, 173 V, 160/168.1 V, 176.1 V, 900, 172 V, 232; 49/92.1

[56] References Cited

U.S. PATENT DOCUMENTS

| | | | |
|---|---|---|---|
| 2,103,788 | 12/1937 | Mohrfeld . | |
| 2,217,217 | 10/1940 | Engstrom . | |
| 3,851,699 | 12/1974 | Shapiro . | |
| 3,946,789 | 3/1976 | Ronkholz-Tolle, nee Tolle . | |
| 4,486,073 | 12/1984 | Boyd . | |
| 4,509,825 | 4/1985 | Otto et al. . | |
| 4,535,828 | 8/1985 | Brockhaus . | |
| 4,541,328 | 9/1985 | Brzezinski et al. | 49/92.1 |
| 4,773,733 | 9/1988 | Murphy, Jr. et al. . | |
| 4,913,216 | 4/1990 | Lemay . | |
| 4,966,219 | 10/1990 | Sonolet . | |
| 4,993,469 | 2/1991 | Moench . | |
| 5,102,598 | 4/1992 | Chen . | |
| 5,105,870 | 4/1992 | Merjane | 160/236 |
| 5,121,785 | 6/1992 | Ohsumi . | |
| 5,141,042 | 8/1992 | Schwaegerle . | |
| 5,203,394 | 4/1993 | Hailey | 160/236 |

FOREIGN PATENT DOCUMENTS

| | | | |
|---|---|---|---|
| 487997 | 6/1992 | European Pat. Off. | 160/236 |

*Primary Examiner*—David M. Purol
*Attorney, Agent, or Firm*—Rader Fishman & Grauer PLLC

[57] ABSTRACT

A vertical blind has individual vertically extending vanes that include vertically extending interior compartments. The compartments are created by bonding a corrugated or pleated first member to a generally planar second member. In the first several embodiments, the members of each vane are formed of a relatively flexible, translucent sheet of material. A method of diffusing light through the translucent members of the vane and interior compartment is disclosed. In an alternate embodiment of the invention, the vertical vane is comprised of a relatively thick and rigid backing member wherein the thinner front member is bonded to the backing member to form the vertically extending interior compartments. In this embodiment, one vertical edge of the room-facing side of the vane is flattened, such that adjacent vanes are able to overlap.

9 Claims, 3 Drawing Sheets

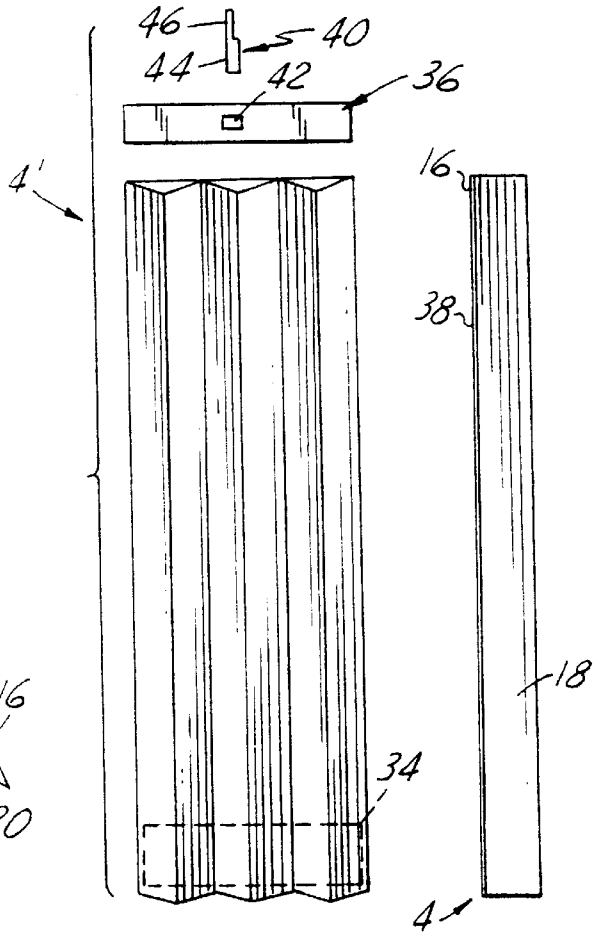
FIG.7
FIG.6
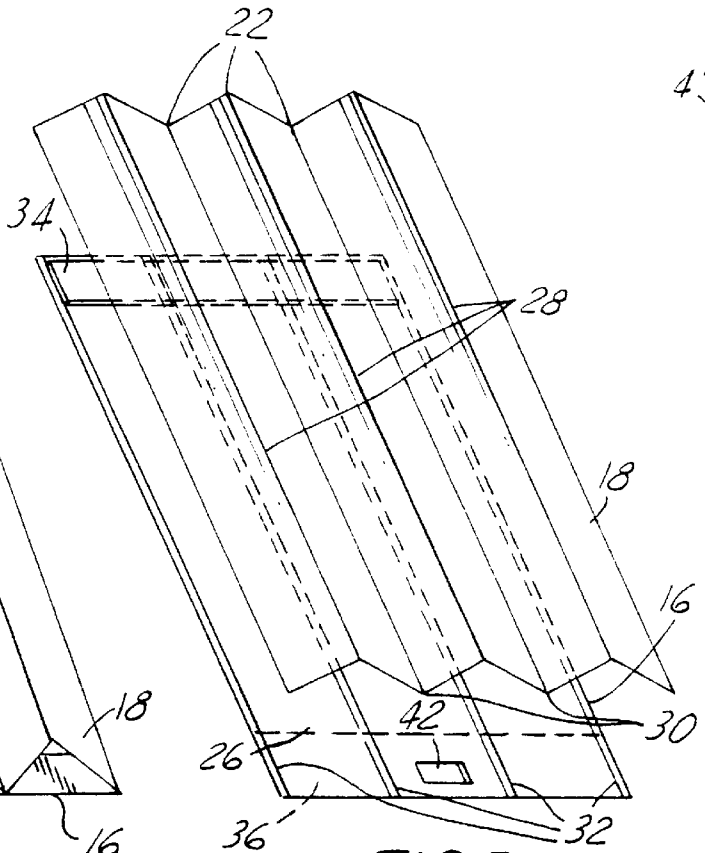
FIG.5
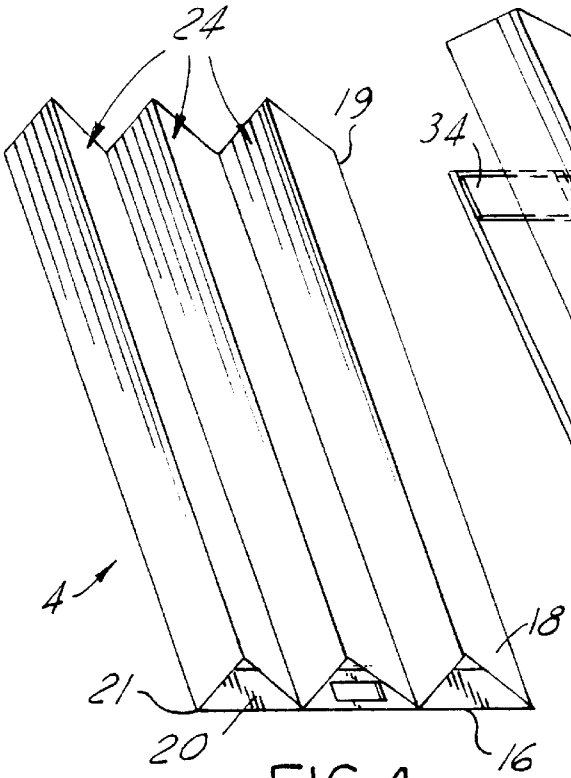
FIG.4

VERTICAL BLIND HAVING HONEYCOMB-SHAPED VANES

This is a continuation-in-part of application Ser. No. 7/ 994,673 filed on Dec. 22, 1992, now abandoned.

FIELD OF THE INVENTION

The invention is in the field of window coverings. More particularly, the invention is a vertical blind wherein the individual vanes have a unique shape and construction. The front side of each vane is formed from a pleated, translucent sheet of material. This sheet is bonded directly to a generally planer sheet of material that forms the vane's rear surface. This construction creates a plurality of triangular air pockets/compartments within each vane.

BACKGROUND OF THE INVENTION

Vertical blinds have become extremely popular in recent years. These blinds differ from the more traditional venetian blinds in that each vane extends vertically downward from a horizontally oriented support in lieu of extending horizontally between two vertically oriented supports.

In a typical vertical blind, the vanes (also called slats or louvers) extend downwardly from a top located adjustable support called a head rail. Adjustment of the head rail can cause the vanes to either rotate in place or to move across the window opening.

The individual vanes are formed from either a flat, flexible material that is usually translucent (transmits light in a diffused fashion), or they are formed from a semi-rigid or rigid opaque material that is usually bowed to increase its stiffness. The vanes are normally a solid color and sometimes include fasteners that allow a user to affix a strip of patterned cloth or other material to the vane's front (room facing) surface.

As vertical blinds have become more popular, some inherent problems in their design have become apparent. Firstly, the blinds that have thin, translucent vanes do not sufficiently diffuse the light that passes through the vanes. During the day, an object or person located exterior to but near the rear surface of the blind will cast a shadow or silhouette on the blind that is transmitted to the front surface of the blind and is easily seen from the interior of the room. This can be distracting to a person within the room. At night, this same characteristic of the blind allows a viewer outside the house to discern shadows or silhouettes cast by objects or people within the room. This diminishes the privacy afforded by the blinds.

A second problem with blinds that have thin vanes is that the flexibility inherent in the vanes allows them an excessive degree of movement. For example, slight air currents can cause the vanes to swing.

A third problem with thin vanes is that they are not substantial looking. The vanes appear fragile, and this causes a consumer to doubt their durability. This effect also detracts from the blind's aesthetic appearance.

The vertical blinds that have thicker vanes also have their own set of unique problems. Firstly, many users prefer blinds that allow a small amount of light into the room even when the blinds are closed. Since the thickness of the vanes is usually directly proportional to their ability to transmit light, blinds that use thick, substantial looking vanes are normally opaque to light. These thicker vanes are relatively heavy and are therefore costly to produce and difficult to install. Furthermore, the prior art thicker vanes do not provide insulation and sound dampening. Further, light is not diffused when passing between the prior art thicker vanes when in the open or partially open conditions.

Problems with prior art vertical blinds also arise when it is desired to have the front surface of each vane a different color from that of the rear surface. This is extremely difficult to achieve with the thin vanes since the translucent nature of the vane allows the color of either side to "bleed " through the vane and be visible from the opposite side. With the thicker vanes, color transmission is not a problem due to their opaque nature. However, painting the thicker vanes increases the cost, as does adding an attachment mechanism for the attachment of a colored strip of material to the vane's front surface. Another problem with the vertical blinds with a front surface having a different color than the rear surface is the overlap of color on the vertically extending edges of each vane. When the blinds are partially open, the vane is rotated to exposes the color of the vertical extending edge. It is desirable, in some instances, for the vertically extending edge to match the color of the front surface, while at the same time remain aesthetically pleasing on the rear surface.

Another problem with the prior art vanes is that the clip used to attach the vane to the head rail is often easily visible from within the room and therefore detracts from the appearance of the blind. This is somewhat overcome in the vanes that receive an added strip of material since the material covers the top of the vane and partially conceals the attachment mechanism. However, the added strip does not effectively conceal the attachment mechanism from a viewer who is located in close proximity to the shade.

An additional problem with the prior art vertical blinds arises when the blinds are used with certain types of draperies. When a typical vertical blind is used in conjunction with a pleated drapery, the relatively flat appearance of the vanes contrasts with the shape of the drapes.

A goal of the present invention is to provide a vane for a vertical blind that overcomes the above problems. More specifically, a goal of the first several embodiments of the present invention is to provide a translucent vane for a vertical blind that provides thermal insulation and image distortion, as well as having increased stiffness over the prior art translucent vanes.

A goal of an alternate embodiment of the present invention is to provide a vertical blind having thicker opaque vanes, that further include forwardly projecting air pockets on each vane, which extend along a vertical axis. The air pockets provide insulation, sound dampening, light diffusion and viewing distortion. A further goal of this embodiment is to provide a vertical blind vane having vertically extending air pockets, wherein adjacent vanes are able to overlap and closely abut a portion of an adjacent vane in the fully closed condition. A further goal is to provide a vane formed of two colors which is aesthetically pleasing.

SUMMARY OF THE INVENTION

The invention is a vertical blind that makes use of uniquely shaped vanes that have relatively large air pockets/compartments between their front and rear surfaces. The vanes are suspended from a standard type of head rail and can be rotated in place or caused to slide to one end of the head rail.

In the first several embodiments of the invention, each vane is fashioned from two sheets of paper-like translucent material. The first sheet provides a flat, level surface that forms the rear surface of the vane, the surface that normally faces the window when the blind is fully closed. The second sheet is used to form the vane's front surface. Unlike the first sheet, the second sheet has a plurality of longitudinally aligned crisp pleats/folds that give the sheet an accordion shape.

Prior to assembling the vane, the second sheet has a greater width than the first sheet. During assembly, it is compressed until its width matches that of the first sheet. Lines of glue are then placed longitudinally on the back surface of the first sheet and the sheets are pressed together with the glue contacting the base of every other pleat/crease of the second sheet as well as the sheet's edges. The folds in the second sheet cause portions of the sheet to extend away from the first sheet. This results in the formation of longitudinally aligned compartments/air pockets within each vane.

The plurality of elongated air pockets as defined by the forwardly projecting portions of the second sheet creates a unique effect when light is passing through the vane. Since each of the vane's two layers is translucent in the first several embodiments, at least some light is allowed to pass through the vane. However, unlike the prior art vanes, the front and rear surfaces of each vane are unequal in surface area, and part of the light is also reflected within the air pockets/compartments. This causes a degree of muting or diffusing of the transmitted light not found in the prior art. In addition, when an object passes between a vane and a light source, the shadow or silhouette caused by the object becomes extremely blurred as it is transmitted through the vane. This makes recognition of the object difficult, thereby increasing the privacy afforded by the blind at night and reducing daytime distractions caused by shadows. A method of diffusing light through the translucent layers and the air pocket formed therebetween is disclosed.

The invention's construction provides a number of other distinct advantages. Sheets of lightweight material are used to fashion the vanes. Due to the pleating of the second sheet and its initial semi-compression, the assembled vane is much more rigid than the thin vanes of the prior art. In this manner, the vane construction enables the light transmissivity of the prior art thin vanes while avoiding the problems associated with their flexibility. In addition, the advantages of rigidity are obtained using lightweight, inexpensive materials for the vane construction.

Using two sheets to construct each vane greatly facilitates the ability to have the front of the vane a different color than the vane's rear surface. The problem of color bleed between the front and rear vane surfaces is substantially alleviated since the air pocket structures minimize the direct contact between the two sheets.

An alternate embodiment of the invention is similar in structure to the first several embodiments, but includes a vane having a relatively rigid backing member in place of the thin, translucent sheet of material. The backing member of this embodiment is formed of extruded opaque or translucent vinyl. A relatively thin front sheet is secured to the backing member in a manner that defines a plurality of vertically extending air pockets. One vertical edge section of the room-facing side of the vane is flattened. Along the flattened section, the front sheet contacts the backing member without forming an air pocket. The flattened section is the approximate width of one of the air pockets. An adjacent vane may thereby overlap the room-facing side of the vane along the flattened section when the blind is in the fully closed condition. Further, the front sheet of material wraps around the extreme edges of each vane so that the color of the front sheet can be seen along each edge of the vane. The front sheet is attached to the backing member by an ultrasonic welding process that thermally locks portions of the front sheet into vertically extending channels formed on the backing member.

Several advantages are afforded by the invention due to its geometry. The forwardly projecting portions of the vane's front surface tend to trap and absorb sound waves. The compartments located between the front and rear surfaces of each vane provide the vane with an insulating capacity that enhances the thermal performance of the blind as compared to the prior art.

In addition, the increased thickness of the vanes makes them more substantial looking. A further advantage is that when a vertical blind in accordance with the invention is used in a window that has pleated drapes, the pleated front surface of the vanes does not contrast with the drapery.

BRIEF DESCRIPTION OF THE DRAWINGS

FIG. 4 is a perspective view of one of the vanes of the blind shown in FIG. 1.

FIG. 5 is an exploded view of the vane shown in FIG. 4.

FIG. 6, is a perspective view of a vane similar to the one shown in FIG. 4 and details an alternate attachment of a stiffener and carrier clip.

FIG. 7 is a side view of the vane shown in FIG. 4.

DETAILED DESCRIPTION OF THE DRAWINGS

Figure 3:
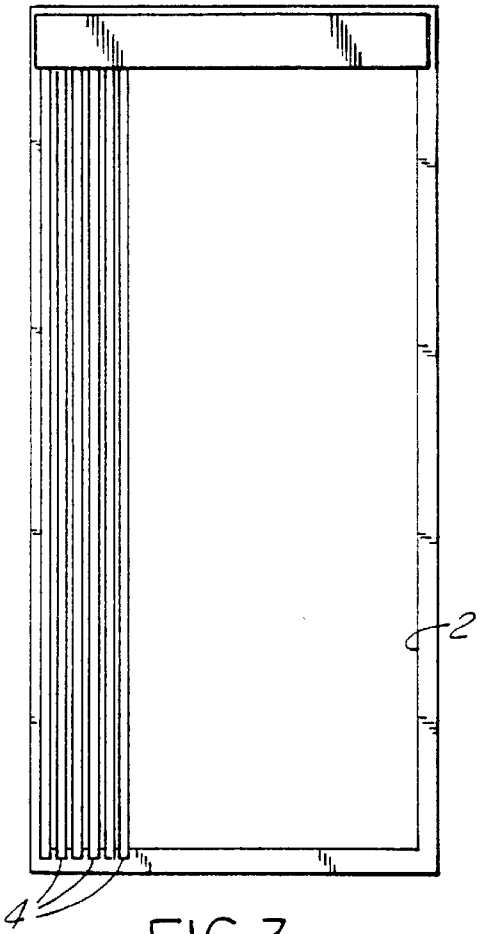
FIG. 3 is a front view of the blind shown in FIG. 1 with the blind in a fully open condition.

Referring now to the drawings in greater detail, wherein like reference characters refer to like parts throughout the several figures, there is shown by the numeral 1 a vertical blind in accordance with the invention.

Figure 1:
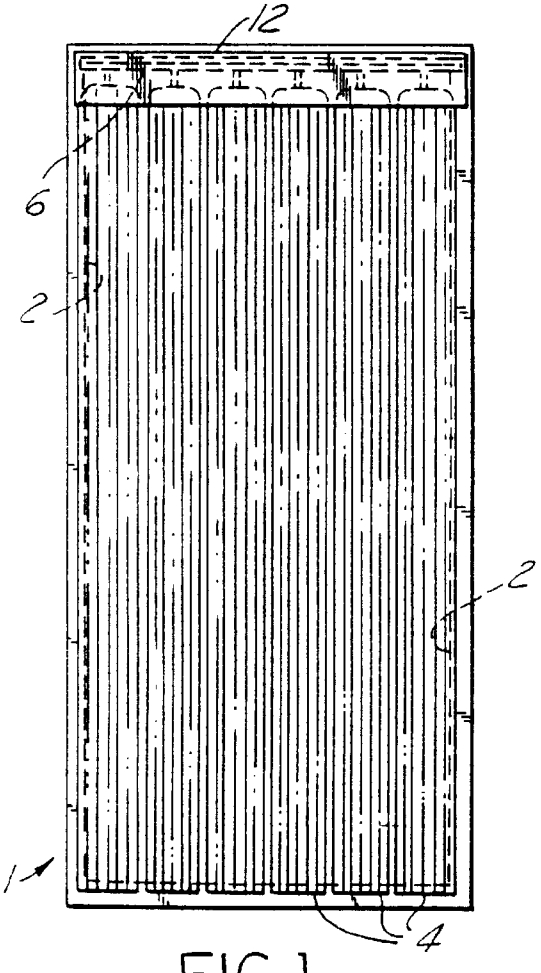
FIG. 1 is a front view of a vertical blind in accordance with the invention with the blind in a fully closed condition.

FIG. 1 shows the blind in a fully closed condition in front of a window opening 2 (shown in phantom in FIG. 1). The blind consists of a plurality of individual vanes 4 that are hung from a top located head rail 6 (shown in phantom in FIG. 1) that is of the type normally used for vertical blinds. Adjusters 8 and 10 (shown in FIG. 2 only) are located at the extreme left side of the blind to enable a user to rotate the vanes or to cause the vanes to slide across the window opening. A fixed cover 12 is used to conceal the head rail.

Figure 2:
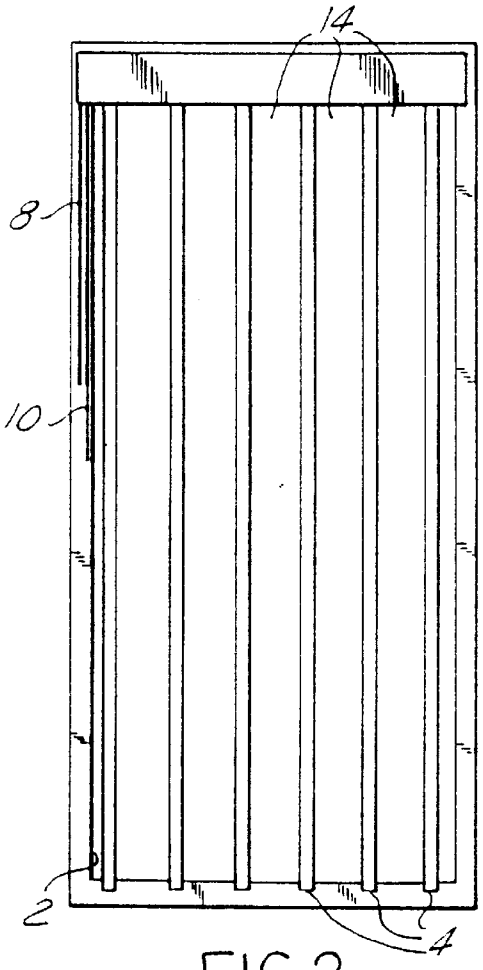
FIG. 2 is a front view of the blind shown in FIG. 1 with the blind in a semi-open condition.

FIG. 2 shows the blind in a semi-open condition in which the vanes have been rotated ninety degrees from the orientation shown in FIG. 1. In this position, light can pass directly through the blind via spaces 14 between adjacent vanes 4.

FIG. 3 shows the blind in a fully open condition. The vanes have all been moved to the extreme left side of the head rail and are oriented in front-to-back contact.

FIG. 4 provides a perspective view of one of the vanes 4. Each vane is fashioned from a rear sheet 16 and a front sheet 18. Sheets 16 and 18 are preferably a paper, vinyl or fabric material that is translucent to light. In this manner, a portion of any light that impinges on the surface of the sheets is transmitted through the sheet while being diffused in the process.

In FIG. 4, one can also clearly see the triangularly shaped air pockets/compartments 20 that are sandwiched between the vane's front and rear sheets. It should be noted that the air pockets/compartments extend from the vane's bottom end 19 to its top end 21.

FIG. 5 provides a detailed view of one method of constructing a vane 4. In this view, rear sheet 16 is clearly visible and defines a flat, plane-like surface. Front sheet 18 includes a plurality of longitudinally aligned creases or folds 22 that cause the sheet to assume an accordion shape. Each V-shaped forwardly projecting section 24 of the sheet will form two sides of the pocket 20 when the sheets are bonded together. For clarity of description, the folds that are located at a distance from the front surface 26 of sheet 16 are numbered as 28 and the folds that will contact sheet 16 are numbered as 30.

Strips 32 of glue are applied to surface 26 of sheet 16 in order to affix or bond the folds 30 and side edges of sheet 18 to sheet 16. Alternately, the glue may be similarly applied to sheet 18 in lieu of to sheet 16. It should be noted that other bonding methods may be substituted such as stitching, thermal welding or mechanical fasteners such as staples.

As shown in FIG. 5, the rear sheet 16 may be modified prior to the bonding process by the addition of a weight 34 and a top stiffener/hanger 36. The weight is secured to the bottom end 19 of the vane and will be located proximate the bottom of the window opening when the vane is hanging from the head rail. The stiffener/hanger 36 is located at the top end 21 of the vane. Attachment of the weight 34 and stiffener 36 to surface 26 of the rear sheet will normally be accomplished by a gluing process. It should be noted that alternate well-known attachment methods may be employed such as mechanical fasteners or by creating pockets on the sheet into which the weight and stiffener may be inserted. Once the vane has been assembled with the two sheets 16 and 18 bonded together, both the weight 34 and the stiffener 36 will be located within the vane and thereby concealed from view.

FIG. 6 shows an alternate embodiment of a vane 4'. In this embodiment, the two sheets 16 and 18 are bonded together as previously described. After the bonding process has been completed, the weight 34 and stiffener 36 are glued to the back surface 38 of sheet 16 at the appropriate ends of the vane. It should be noted that it is also within the scope of alternate fabrication methods to insert and secure the stiffener and weight within the vane after the sheets have been bonded together.

The accordion/corrugated shape of sheet 18 is complementary to the standard securement method used to hang the vanes from the head rail. As can be seen in FIG. 6, a clip 40 is normally used to removably attach the vane to the head rail. The attachment to the vane is made by inserting a hook portion (not shown) of the clip into hole 42 of the stiffener 36. Once in place, the bottom portion 44 of the clip will be concealed by the vane and only the top portion 46 of the clip will extend outwardly from the top of the vane. Preferably, when the front sheet 18 is bonded to the rear sheet 16, the hole 42 will be aligned with one of the folds 28 to thereby facilitate access to hole 42.

FIG. 7 provides a side view of vane 4 prior to attachment of clip 40. In this view it can be seen that the majority of the vane's thickness results from the forwardly projecting portions 24 of sheet 18.

The structure of each vane 4 diffuses the transmitted light in a unique fashion compared to the prior art. The two sheets act together to block out a large percentage of the impinging light as would be desired for a blind. However, the light that does pass through the vanes is initially diffused by the first sheet it contacts and then either directly contacts the second sheet at one of the folds 30 or enters into one of the air pockets 20 between the sheets. When light enters one of the pockets 20, it will proceed from the first sheet through the air space before it contacts the material of the second sheet. When traveling from sheet 16 to sheet 18, it will impinge at an angle on the material of sheet 18 since the sides of the V-shaped portions 24 are oriented at an angle to the plane formed by surface 26 of sheet 16. In this manner, there will normally be an accentuation of the light blocking and diffusion effect caused by the material of sheet 18. In other words, having one sheet at an angle to the other sheet changes the light transmission characteristics of the combined structure. Furthermore, the open area within each pocket thereby increases the light's diffusion before passing through sheet 18. This same process occurs when light is traveling in the opposite direction from sheet 18 to sheet 16.

There is another way of looking at the structural relationship that affects the light transmissivity of the vanes in the areas of the pockets 20. When two sheets of material are in a face-to-face orientation wherein each has the same surface area and outer dimensions, light passing through both sheets will be blocked and diffused by a certain amount. In the invention, the sheets are in a face-to-face relationship and have the same outer dimensions. However, the surface area of sheet 18 is significantly larger than the surface area of sheet 16. The open areas enable an amount of light reflection between the two layers and thereby create a different degree of light blocking/diffusion by the vane than would occur if both sheets had the same surface area.

When the blind is in the fully closed condition shown in FIG. 1, almost all of the light impinging on the back surface 38 of the vanes is blocked by the vanes. A small amount of light will be allowed to pass through the vanes but in a very diffused fashion. A viewer looking at the blinds from within the room will notice that each of the vane pockets 20 will be slightly darker than the area where the sheets are directly bonded together (at creases 30). In this manner, the blind will have a unique appearance.

The diffusion characteristics of the vanes become especially important when an object or person passes between the vanes and the light source. Instead of presenting a clearly defined shadow or silhouette to the opposite side of the blind, the image will be significantly blurred due to the light diffusing characteristics of the pocket structures 20. This makes a shadow cast on the blind during the day by a person or object less distracting to someone within the room. In addition, the blind will produce a similar effect at night so that someone exterior to the room cannot easily discern people or objects within the room.

A method of diffusing light through a plurality of vertically extending vanes 4 of a vertical blind 1 is disclosed which distorts a silhouette or shadow of an object cast on the vanes, comprising the steps of: 1) providing a plurality of vertically extending vanes 4, each vane of the plurality of vanes having a first translucent layer 16 and a second translucent layer 18, the second translucent layer 18 having forwardly projecting portions 24 which are spaced from the first translucent layer 16 to define air pockets 20 therebetween, the second translucent layer 18 having portions which are non-parallel to the first translucent layer 16; 2) diffusing light through the first translucent layer 16; 3) diffusing light through the air pocket 20; and 4) diffusing light through the second translucent layer 18, whereby light is reflected and diffused within the air pocket before being further diffused when passing through a non-parallel portion of the second translucent layer.

When the blind is in the semi-open condition shown in FIG. 2, a large amount of light will be able to enter the room through spaces 14 between the vanes. The thickness of each of the vanes will tend to block out more light than the thin vanes of the prior art. However, depending on the number of pockets in each vane, some light may additionally be able to enter the room by passing through the width of the vanes. This can allow a significant amount of diffused "soft" light to enter the room as compared to either the translucent or opaque prior art blinds when in a similar orientation.

It should be noted that a number of variations can be made to the basic design of the vanes without departing from the basic concepts of the invention. While the figures show vane 4 as having three V-shaped structures, sheet 18 may be folded with more or less creases thereby increasing or decreasing the number of pockets 20. The size and height of the pockets 20 are similarly variable. The shape of the pockets can also be changed so that they are, for example, round, square or rectangular. Furthermore, the pockets 20 can be oriented so that they are perpendicular to the vane's longitudinal axis. Sheets 16 and 18 may be separate pieces or they may be fashioned from a single sheet that is folded to create the two surfaces.

While one embodiment of the invention makes use of a flat sheet mated to a pleated sheet, an alternate embodiment of the invention can employ two pleated sheets with one of the pleated sheets taking the place of the flat sheet. In this embodiment, the air pockets 20 would be formed by bonding the two sheets together at adjacent crease points thereby giving the vane a herringbone-type configuration when viewed in cross-section with each pocket having a diamond shape.

Another alternate embodiment of the vanes uses an opaque material for one or both of the sheets 16 and 18. For this embodiment, the user can take advantage of the sound dampening characteristics of the vanes, their substantial appearance, ability to visually conform to pleated draperies and their added thermal performance achieved through the insulating ability of the air pockets located between the front and rear sides of each vane. The thermal properties of the vanes can be further enhanced by the placement within the pockets 20 of a lightweight, flexible foam or other type of material.

Figure 8:
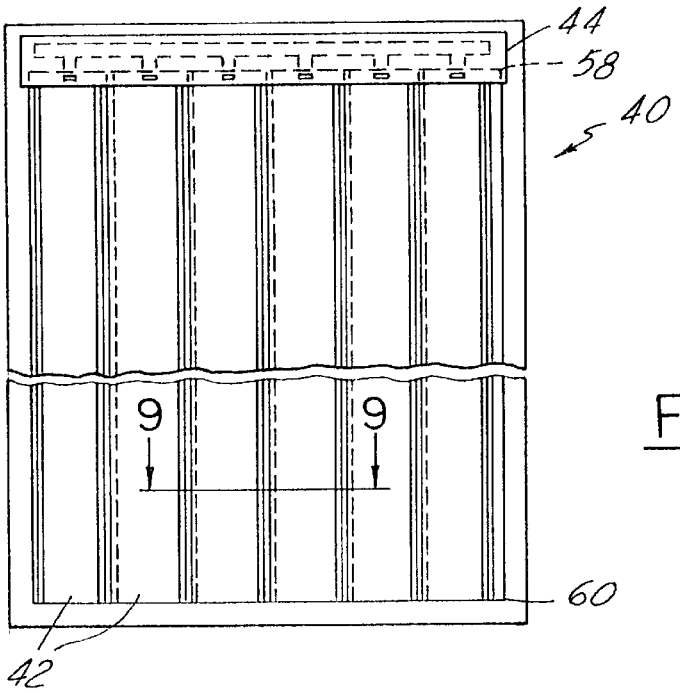
FIG. 8 is a front view of an alternate embodiment of a vertical blind in a fully closed condition.

FIG. 8 shows an alternate embodiment of a vertical blind 40 in a fully closed condition in front of a window opening. The blind 40 consists of a plurality of individual vanes 42 that are hung from a top located head rail 44 that is of the type normally used for vertical blinds. Attachment of the vanes 42 to head rail 44 is the same as described in the previous embodiments. Adjustment of the head rail causes the vanes to either rotate in place to the partially open condition, similar to FIG. 2, or to move across the window opening to the fully open condition, similar to FIG. 3.

Figure 9:
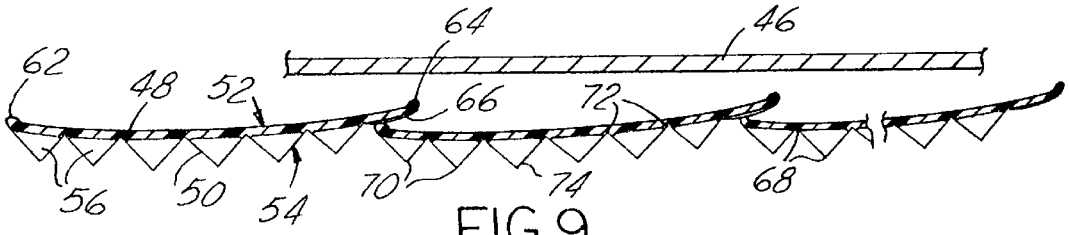
FIG. 9 is a cross-sectional view along line 9—9 of FIG. 8.

FIG. 9 provides a cross-sectional view of the overlapping vanes 42 of the embodiment of FIG. 8, and shows a window 46 which is covered by the vertical blind 40. A rear surface 48 of each vane 42 faces window 46, while a front surface 50 of each vane faces the interior of the room. Each vane 42 is fashioned from a relatively thick backing member 52 and a relatively thin front sheet 54. Backing member 52 is preferably formed from extruded opaque or translucent vinyl, and front sheet 54 is formed from a paper, vinyl or fabric material that is translucent to light. Backing member 52 is relatively rigid in comparison to front sheet 54. Backing member 52 is slightly curved to define an arcuate cross-section, which provides additional stiffening for vane 42.

Triangularly shaped air pockets/compartments 56 are sandwiched between the vane's rear surface 48 and front surface 50. Each air pocket 56 extends along a vertically oriented longitudinal axis from a top end 58 of the vane to a bottom end 60, as seen in FIG. 8. Each vane includes an extreme left edge 62 and an extreme right edge 64, the horizontal extent of vane 42 being defined between the extreme edges 62 and 64.

It may be desired for backing member 52 and front sheet 54 to be two different colors. Due to the relative thickness of backing member 52, front sheet is able to wrap around extreme edges 62 and 64 of each vane so that the color of the front sheet can be seen along each vertical edge of the vane. In this manner, when vanes 42 are rotated to be generally perpendicular to window 46 as in the partially open and fully open conditions, vanes 42 appear to be the color of front sheet 54.

A flattened section 66 of the room-facing side of vane 42 extends vertically and is adjacent extreme right vertical edge 64. Flattened section 66 is the approximate horizontal width of one of the air pockets 56. A second vane overlaps its adjacent vane along the flattened section 66 when the vertical blind 40 is in the fully closed condition. In this manner, vanes 42 are able to more effectively cover window 46, and trap insulating air between the window and the vanes, without gaps being created between the vanes for air passage. Further, the overlapping of vanes allows the pattern of air pockets 56 on the aligned vanes to continue across the full horizontal extent of vertical blind 40. In other words, an air pocket 56 of one vane is able to closely abut an air pocket 56 of an adjacent vane. Due to flattened section 66, the overlapping is possible while the vanes are in the fully closed condition, while each vane is generally parallel to window 46.

In order form air pockets 56, front sheet 54 includes a plurality of vertically aligned creases or folds 68 that cause the sheet to assume an accordion shape. For clarity, the folds that are located at a distance from the backing member are numbered as 70 and the folds that contact the backing member are numbered as 72. Front sheet 54 thereby forms a V-shaped forwardly projecting portion 74. Each forwardly projecting portion 74 of front sheet 54 forms two sides of air pocket 56 when the sheets are bonded together.

Figure 10:
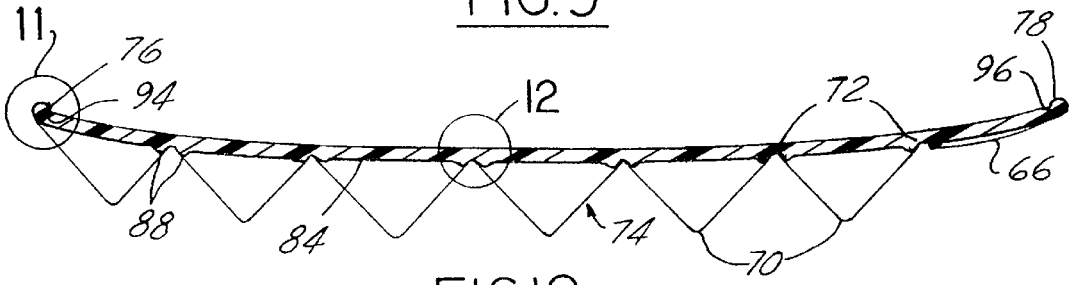
FIG. 10 is an enlarged cross-sectional view of a vane of the vertical blind according to the embodiment of FIG. 8.

FIG. 10 shows an enlarged cross-section of a single vane 42. The bonding of front sheet 54 to backing member 52 is preferable achieved by ultrasonic welding. During ultrasonic welding, backing member 52 and front sheet 54 are pressed together under pressure vibrating at ultrasonic frequency. Backing member 52 and front sheet 54 are made to adhere by the close contact and friction developed by the passage of high frequency energy. The temperatures are kept well below the melting point of the materials. To assist in this process, backing member 52 includes a plurality of vertically oriented channels, which receive portions of front sheet 54, as described below.

Figure 11:
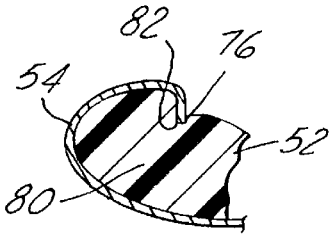
FIG. 11 is an enlarged view of an extreme edge of the vane indicated in FIG. 10.

Rear surface 48 of backing member 52 is generally smooth, except for a V-shaped channel 76 in proximity to extreme left vertical edge 62, and a V-shaped channel 78 in proximity to extreme right vertical edge 64. Channels 76 and 78 extend the full vertical extent of vane 42. FIG. 11 more clearly illustrates the structure of this portion of backing member 52. The surface of extreme vertical edges 62 and 64 are generally arcuate, as seen in transverse cross-section. Channels 76 and 78 extend inwardly into the body 80 of backing member 52, the walls of each channel converging to a peak 82 which is the most inwardly extending portion of the channel.

Figure 12:
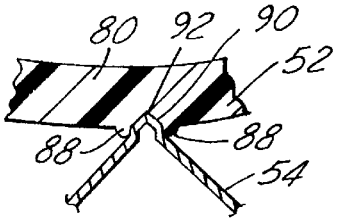
FIG. 12 is an enlarged view of a section of the vane indicated in FIG. 10.

Backing member 52 includes a front facing surface 84. Horizontally spaced across the front facing surface 84 are a plurality of pairs of vertical ridges 88. As more clearly seen in FIG. 12, the pair of ridges extend outwardly from body 80 of backing member 52, and extend the full vertical length of vane 42. Each pair of ridges 88 is horizontally spaced to define a channel 90 having a generally V-shape. Channel 90 further extends inwardly into the body 80 of backing member 52, the walls of channel 90 converging to a peak 92.

An end 94 of front sheet 54 extends into channel 76, while the other end 96 of front sheet 54 extends into channel 78. Front sheet 54 extends around the extreme vertical edges of the backing member to the front facing surface 84. Extreme vertical edges 62 and 64 are covered by front sheet 54. Folds 72 of front sheet 54 are received in each channel 90 formed on front facing surface 84 of backing member 54, while folds 74 are spaced from backing member 52 forming the forwardly projecting portion 74. Forwardly projecting portion 74 thereby defines air pocket 56. Portions of front sheet 54 are bonded to backing member by the ultrasonic welding process, wherein the channel crimps to pinch each portion of front sheet 54 which is received within the channel, as well as thermally locking the mating surfaces together. Because the walls of the channel converge to a peak, a portion of front member 54 is more likely to be pinched in the channel during the bonding process. In the manner described, the front sheet 54 is bonded to backing member 52.

Although ultrasonic welding has been described, it will be apparent to those skilled in the art that other bonding methods may be successfully substituted such as stitching, glue or mechanical fasteners.

This alternate embodiment of vertical blind 40 having a vane 42 with a relatively thick and stiff backing member 52 offers the usual advantages for this type of blind. In addition, air pockets 56 which are formed by the attachment of a front sheet provide thermal insulation, sound dampening, as well as additional image distortion and light diffusion when the vanes are in the opened or partially opened conditions.

Air pockets 56 provide additional thickness, and offer the several advantages as described above. Due to flattened section 66 of vane 66, this alternative embodiment retains the ability of vanes 42 to snugly overlap and abut, notwithstanding the inclusion of forwardly projecting portions 74 defining air pockets 56. Further, when the vane is in the open or partially open conditions, light is diffused when passing through the forwardly projecting portions 74 that define the air pockets 56.

The embodiments disclosed herein have been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. In a vertical blind of the type having a head rail and a plurality of individual, vertically oriented vanes that are attached to and extend downwardly from said head rail, the improvement wherein each of said vanes has a backing member, a front member, a top end, and a bottom end, each of said vanes having a longitudinal axis extending vertically between said top end and said bottom end, said backing member being substantially flat and having relatively greater thickness and rigidity with respect to said front member, said front member having a plurality of forwardly projecting portions defining a plurality of elongated air pockets within said vane that are sandwiched between said front member and said backing member, each of said air pockets having a vertically oriented longitudinal axis, wherein each of said vanes includes a flattened section adjacent a vertical edge of said backing member, wherein said front member is flattened against said backing member a horizontal distance approximately equal to one of said plurality of elongated air pockets, said flattened section being thereby adapted to abut the backing member of an adjacent vane when said vanes are in a closed condition of the blind.

2. The blind of claim 1, wherein said front member is formed of a translucent material.

3. The blind of claim 1, wherein said backing member includes horizontally spaced vertical edges, a rear surface adapted to face a window, and a front surface opposing said rear surface, said rear surface of said backing member being generally smooth, said rear surface of said backing member further including a channel in proximity to each of said vertical edges of said backing member, a vertical edge of said front member being received in each of said channels, said front member extending from said rear surface of said backing member to a front surface of said backing member, whereby said vertical edges of said backing member are covered by said front member.

4. The blind of claim 1 wherein said channel is V-shaped having walls converging to a peak, said end of said front member contacting said peak.

5. The blind of claim 1, wherein said backing member includes horizontally spaced extreme vertical edges, a rear surface adapted to face a window, and a front surface opposing said rear surface, said front surface of said backing member including a plurality of horizontally spaced narrow channels, each said channel extending along a vertical axis, a portion of said front member being received within each said channel and being bonded to said backing member within said channel.

6. The blind of claim 5, wherein said front member is ultrasonically bonded to said backing member.

7. The blind of claim 5 wherein each said channel is further defined by a pair of vertical ridges, said pair of vertical ridges projecting forwardly from a body of said backing member, said vertical ridges of each said pair of ridges being horizontally spaced to further define said channel therebetween.

8. The blind of claim 7 wherein said channel extends inwardly into said body of said backing member.

9. The blind of claim 8 wherein said channel is V-shaped having walls converging to a peak, a portion of said front member contacting said peak.

* * * * *